US011274668B2

(12) United States Patent
Kolvenbach et al.

(10) Patent No.: US 11,274,668 B2
(45) Date of Patent: Mar. 15, 2022

(54) VACUUM PUMP HAVING A SILENCER

(71) Applicant: Leybold GmbH, Cologne (DE)

(72) Inventors: Dieter Kolvenbach, Cologne (DE); Otmar Cornely, Cologne (DE); Peter Birch, Horsham West Sussex (GB)

(73) Assignee: LEYBOLD GMBH, Cologne (DE)

( * ) Notice: Subject to any disclaimer, the term of this patent is extended or adjusted under 35 U.S.C. 154(b) by 35 days.

(21) Appl. No.: 16/088,755

(22) PCT Filed: Mar. 16, 2017

(86) PCT No.: PCT/EP2017/056290
§ 371 (c)(1),
(2) Date: Sep. 26, 2018

(87) PCT Pub. No.: WO2017/167584
PCT Pub. Date: Oct. 5, 2017

(65) Prior Publication Data

US 2019/0113036 A1 Apr. 18, 2019

(30) Foreign Application Priority Data

Mar. 30, 2016 (DE) ..... 202016001950.4

(51) Int. Cl.
*F04C 29/06* (2006.01)
*F04C 29/12* (2006.01)
(Continued)

(52) U.S. Cl.
CPC ..... *F04C 25/02* (2013.01); *F04C 29/061* (2013.01); *F04C 29/068* (2013.01); *F04C 29/12* (2013.01);
(Continued)

(58) Field of Classification Search
CPC ..... F04C 25/02; F04C 29/061; F04C 20/068; F04C 29/12; F04C 29/065; F04C 29/068;
(Continued)

(56) References Cited

U.S. PATENT DOCUMENTS 4,747,761 A 5/1988 Yumiyama et al.
5,214,937 A * 6/1993 Henrichs ..... F04B 39/16 62/468
(Continued)

FOREIGN PATENT DOCUMENTS

CN 2921361 Y 7/2007
CN 201723403 U 1/2011
(Continued)

OTHER PUBLICATIONS

English translation of CN202914316 by Dialog Oct. 2, 2020.*
(Continued)

*Primary Examiner* — Deming Wan
(74) *Attorney, Agent, or Firm* — Ohlandt, Greeley, Ruggiero and Perle, LLP

(57) ABSTRACT

A vacuum pump comprises rotor elements arranged in a suction chamber. An outlet duct is connected to an exhaust pipe. For the purpose of silencing, sound expansion spaces are provided in the outlet duct, which are integrated into the pump housing. Alternatively or in addition to these sound expansion spaces, sound expansion spaces may be provided in an inlet duct which is used for the inlet of gas ballast, said sound expansion spaces being preferably likewise integrated into the pump housing.

9 Claims, 3 Drawing Sheets

(51) Int. Cl.

| | |
|---|---|
| ***F04D 19/04*** | (2006.01) |
| ***F04D 17/12*** | (2006.01) |
| ***F04C 11/00*** | (2006.01) |
| ***F04C 25/02*** | (2006.01) |
| *F04C 23/00* | (2006.01) |
| *F04C 18/12* | (2006.01) |
| *F04B 53/00* | (2006.01) |

(52) U.S. Cl.
CPC ..... *F04B 53/001* (2013.01); *F04C 18/123* (2013.01); *F04C 18/126* (2013.01); *F04C 23/001* (2013.01); *F04C 29/065* (2013.01); *F04C 2220/50* (2013.01); *F04C 2250/101* (2013.01)

(58) Field of Classification Search
CPC ..... F04C 11/001; F04C 11/003; F04C 11/008; F04D 19/04; F04D 17/122; F04D 17/12
See application file for complete search history.

(56) References Cited

U.S. PATENT DOCUMENTS

| | | | | |
|---|---|---|---|---|
| 5,399,817 | A * | 3/1995 | Berges | F04C 29/06 181/228 |
| 5,733,104 | A * | 3/1998 | Conrad | F04D 19/046 417/202 |
| 6,123,516 | A | 9/2000 | Burghard et al. | |
| 6,425,742 | B1 | 7/2002 | Fukuda et al. | |
| 6,733,258 | B2 * | 5/2004 | Okada et al. | F04C 29/04 418/83 |
| 7,186,098 | B2 | 3/2007 | Dreifert | |
| 7,549,509 | B2 * | 6/2009 | Lucas | F04B 39/0055 181/212 |
| 8,794,377 | B2 | 8/2014 | Heo et al. | |
| 2003/0077182 | A1 | 4/2003 | Naito et al. | |
| 2004/0170516 | A1 | 9/2004 | Hinchey, Jr. | |
| 2006/0127235 | A1 | 6/2006 | Shoulders | |
| 2006/0222506 | A1 * | 10/2006 | Rival | F04C 28/02 417/2 |
| 2007/0031263 | A1 * | 2/2007 | Stones | F04D 19/046 417/199.2 |
| 2009/0041594 | A1 * | 2/2009 | Yokoi | F04C 2/14 417/310 |
| 2009/0090579 | A1 | 4/2009 | Nishida et al. | |
| 2010/0150760 | A1 * | 6/2010 | Yamamoto | F04C 18/126 418/9 |
| 2014/0112814 | A1 * | 4/2014 | Kudara | F04C 18/126 418/9 |

FOREIGN PATENT DOCUMENTS

| | | | |
|---|---|---|---|
| CN | 101988488 | A | 3/2011 |
| CN | 102220981 | A | 10/2011 |
| CN | 202914316 | * | 5/2013 |
| CN | 104696221 | A | 6/2015 |
| DE | 9006233 | U1 | 9/1991 |
| DE | 4213330 | A1 | 10/1993 |
| DE | 19709206 | A1 | 9/1998 |
| DE | 10212940 | A1 | 10/2003 |
| DE | 69719642 | T2 | 10/2003 |
| DE | 19882899 | B3 | 4/2009 |
| EP | 2378125 | A2 | 10/2011 |
| JP | S5927185 | U | 2/1984 |
| JP | S6069375 | U | 5/1985 |
| JP | H07217563 | A | 8/1995 |
| JP | 2005171766 | A | 6/2005 |
| JP | 2011226366 | A | 11/2011 |
| JP | 2012087698 | A | 5/2012 |
| JP | 2013134992 | A | 7/2013 |

OTHER PUBLICATIONS

Chinese Search Report dated Aug. 22, 2019 for Chinese application No. 2017800146518.
Chinese Office Action dated Apr. 28, 2019 for Chinese application No. 201780014651.8.
Chinese Search Report dated Apr. 19, 2019 for Chinese application No. 201780014651.8.
German Search Report dated Jan. 19, 2017 for German application No. 20 2016 001 950.4.
International Search Report dated Jun. 8, 2017 for PCT application No. PCT/EP2017/056290.
Japanese Office Action dated Feb. 2, 2021 for Japanese application No. 2018-550739.

* cited by examiner

VACUUM PUMP HAVING A SILENCER

BACKGROUND

1. Field of the Disclosure

The disclosure relates to a vacuum pump, in particular a two-shaft vacuum pump, such as a claw vacuum pump or a Roots vacuum pump, for example.

2. Discussion of the Background Art

Such vacuum pumps comprise a pump housing which defines a suction chamber. The suction chamber has connected thereto a gas inlet as well as a gas outlet. Inside the suction chamber rotor elements are arranged, wherein in the case of claw pumps or Roots pumps and the like they are rotor elements which are arranged on two shafts. The two shafts are respectively supported in the pump housing. The vacuum pump is in particular configured as a multi-stage vacuum pump. Depending on the requirement, it is common practice to connect one of the last stages with an inlet duct for the inlet of gas ballast. Here, air with an atmospheric pressure or another gas can be used as the gas ballast, for example.

In particular in the case of pre-vacuum pumps with high shaft speeds loud noises occur when pumping against the atmosphere. For silencing the noises, it is common practice to connect an external silencer to the gas outlet. Even when an inlet duct for gas ballast is provided, loud noises occur when the gas ballast is opened against the atmosphere. For silencing this sound, it is common practice to also provide an external silencer at the gas ballast inlet. Silencers which are connected to the vacuum pump frequently comprise a silencing material arranged in the silencer. In the case of moisture, that is in particular when wet gases are pumped, this is disadvantageous in that the moisture accumulates in the silencer and may damage it and long drying time are required. The liquid absorption may possibly lead to a loss or at least a deterioration of the silencing effect. Further, contaminants may deposit in such an absorption material, wherein cleaning of the silencer is a complex process.

In particular when vacuum pumps are used in a laboratory or other fields where persons work, it is required to silence the occurring noises. Here, provision of external silencers is, however, disadvantageous in that they require additional space. This is in particular disadvantageous in laboratories and the like.

It is an object of the disclosure to develop a vacuum pump where silencing can be realized in a simple and space-saving manner.

SUMMARY

The silenced vacuum pumps according to the disclosure are in particular pre-vacuum pumps delivering against the atmosphere. In particular, they are two-shaft vacuum pumps, such as claw pumps or Roots pumps.

The vacuum pump comprises a suction chamber arranged in a pump housing. The suction chamber has connected thereto a gas inlet and a gas outlet. Inside the suction chamber rotor elements are arranged, wherein, preferably, these rotor elements are held by two shafts which are supported in the pump housing. Preferably, in the direction of delivery a plurality of rotor elements, in particular rotor element pairs, are arranged one behind the other such that a plurality of successive pump stages are formed. The vacuum pump according to the disclosure may be a vacuum pump with or without an inlet duct for gas ballast. If an inlet duct for gas ballast is provided, it preferably leads to the atmosphere such that ambient air is used as gas ballast. Likewise, depending on the field of application another gas may be used as gas ballast such that the gas ballast is connected to a corresponding gas supply system. The inlet duct for gas ballast is usually connected to one of the last pump stages.

According to a first preferred embodiment of the disclosure, the loud and possibly high-frequency noises occurring when gas ballast is used are silenced. For this purpose, between duct sections of the inlet duct at least one sound expansion space is arranged, in particular integrated into the pump housing. By providing at least one such sound expansion space the silencing is performed according to the principle of an expansion silencer.

According to a second preferred embodiment, which is an independent disclosure, a vacuum pump, which may not comprise an inlet duct for gas ballast or where such an inlet is not provided with at least one sound expansion space, is proposed where the gas outlet of in particular the last pump stage has connected thereto a discharge duct. Preferably, the discharge duct has connected thereto an exhaust pipe through which the gas is delivered into the atmosphere or an evacuation means. For silencing purposes, between duct sections of the discharge duct at least one sound expansion space is provided which is integrated into the pump housing.

Another preferred embodiment of the vacuum pump is a combination of the two embodiments set forth above. In such a vacuum pump thus an inlet duct for gas ballast having at least one sound expansion space on the one hand, and a discharge duct having at least one sound expansion space are provided.

In all embodiments described above it is particularly preferred that the at least one sound expansion space in integrated into the pump housing such that the at least one sound expansion space is arranged in a housing cover and/or a housing side wall. Preferably, the at least one sound expansion space is arranged both in the housing cover and in the side wall to which the housing cover is mounted. This offers the advantage that by simply removing the housing cover the at least one sound expansion space is easily accessible and can thus be cleaned in a simple manner. Further, large expansion spaces can thus be realized in a simple manner.

According to a preferred aspect of the disclosure, the at least one sound expansion space is configured such that at an inlet opening of the sound expansion space a multiple increase of the cross-section as compared with the duct section is realized. In particular, it is preferred that an increase of the cross-section by a multiple as compared with the cross-section of the duct section is realized. Thereby, a good silencing effect can be achieved.

According to another preferred embodiment of the silencers arranged in the inlet duct for gas ballast and/or in the discharge duct for the delivered medium sound expansion spaces are provided. Here, in the inlet duct for the gas ballast at least two and/or in the discharge duct for the gas at least two sound expansion spaces can be arranged. Preferably, they are arranged one behind the other and in series, respectively, in the direction of flow. In addition, it is preferred that the shape and/or the volume of the sound expansion spaces correspondingly arranged one behind the other are essentially completely identical.

According to another preferred embodiment of the sound expansion spaces an inlet and an outlet opening of a sound expansion space, in particular all sound expansion spaces, if a plurality of such spaces are provided, are arranged in a staggered manner relative to each other. In particular, the staggered arrangement is selected such that, as seen in the direction of flow, the inlet opening and the outlet opening do not overlap each other. It is further preferred that both a horizontal and a vertical staggered arrangement are provided.

According to another preferred aspect of the at least one sound expansion space a pipe section is provided. For example, the pipe section is connected with an inlet of the sound expansion space and projects into the latter. In particular, the pipe section has the same diameter as the corresponding duct section. Thereby, further silencing can be achieved. Preferably, both the inlet opening and the outlet opening have respectively connected thereto a pipe section which projects into the corresponding sound expansion space.

In addition to the good silencing effect in particular realized by the preferred embodiments both at the inlet of the gas ballast and in the discharge duct of the gas to be delivered, the configuration of the silencers according to the disclosure is advantageous with regard to the gas ballast inlet in that a rotary valve of a simple configuration can be provided. This is in particular advantageous when the gas ballast inlet leads to the atmosphere. This valve may even be omitted.

Due to the integration of at least one sound expansion space, which is connected to the outlet duct, into the pump housing according to the disclosure, a silenced vacuum pump requiring little installation space can be realized. The same applies to a vacuum pump where instead of or additionally corresponding silencers are connected to the inlet duct of the gas ballast.

With the aid of the vacuum pump according to the disclosure it is in particular possible to taken in gas ballast directly from the atmosphere without producing much noise. In particular, in the preferred embodiments of the preferably several sound expansion spaces small gas flow losses at small pressure losses can be realized. In particular, provision of a housing cover in which at least a portion of the sound expansion space is arranged offers the advantage that they are not easily contaminated and are easy to clean since in particular no narrow ducts or porous materials are used. The sound expansion spaces configured according to the disclosure and provided for silencing purposes may also be used for connection to hermetically sealed pumps. Likewise, it is possible to arrange the sound expansion spaces according to the disclosure in the inlets or outlets of intermediate stages. Further, the corresponding arrangement may be used for exhaust flushing. In addition, handling and placing into operation are simple.

BRIEF DESCRIPTION OF THE DRAWINGS

Hereunder the disclosure is elucidated in detail on the basis of preferred embodiments with reference to the accompanying drawings in which.

DETAILED DESCRIPTION OF THE PREFERRED EMBODIMENT

Figure 1:
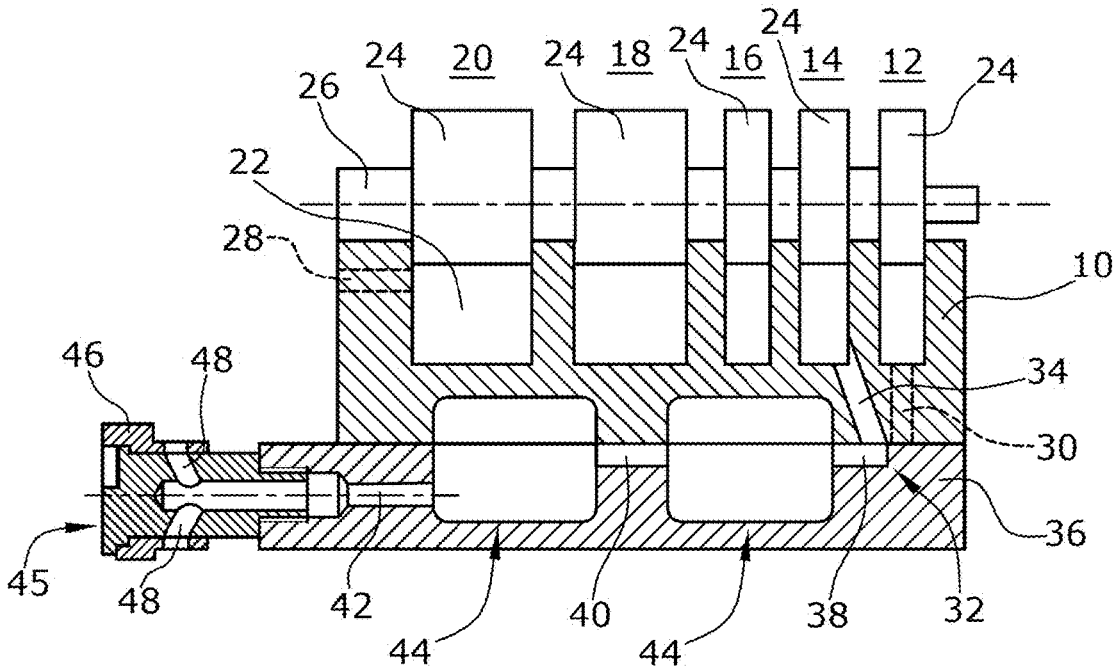
FIG. 1 shows a schematic sectional view of an embodiment according to the disclosure of a vacuum pump having a gas ballast inlet.

In FIG. 1 a vacuum pump having a pump housing 10 is schematically shown. In the pump housing 10 a suction chamber 22 is configured for forming a plurality of stages 12, 14, 16, 18, 20. The illustrated exemplary embodiment is a claw pump, for example, wherein per stage one rotor element 24 is arranged in the suction chamber 22. The rotor elements 24 are held by a common shaft 26 which is in particular supported in the housing 10. Per pump stage 12, 14, 16, 18, 20 the rotor elements 24 cooperate with a respective further rotor element not shown, wherein these are held by a second shaft.

In FIG. 1 the gas is delivered from the left to the right, wherein the gas is taken in through a gas inlet 28 and discharged via a gas outlet 30.

The last but one pump stage 14 in the exemplary embodiment has connected thereto an inlet duct 32 for feeding gas ballast. The inlet duct 32 comprises a duct section 34 configured as a bore in the housing 10. Further, the inlet duct comprises in a housing cover 36 connected to the housing 10 duct sections 38, 40 configured as grooves and another duct section 42 configured as a bore.

Between two duct sections 38, 40 and 40, 42, respectively, a respective sound expansion space 44 is provided. In the illustrated exemplary embodiment, the sound expansion space is partly provided in the housing cover 36 and partly in the housing 10. Thus the sound expansion spaces 44 are easy to clean by removing the housing cover 36.

In the exemplary embodiment illustrated in FIG. 1, the duct section 42 of the inlet duct 32 has connected thereto an inlet valve 45 for gas ballast. This is a valve having a rotatable valve body 46 for opening and closing valve inlet ducts 48.

Figure 2:
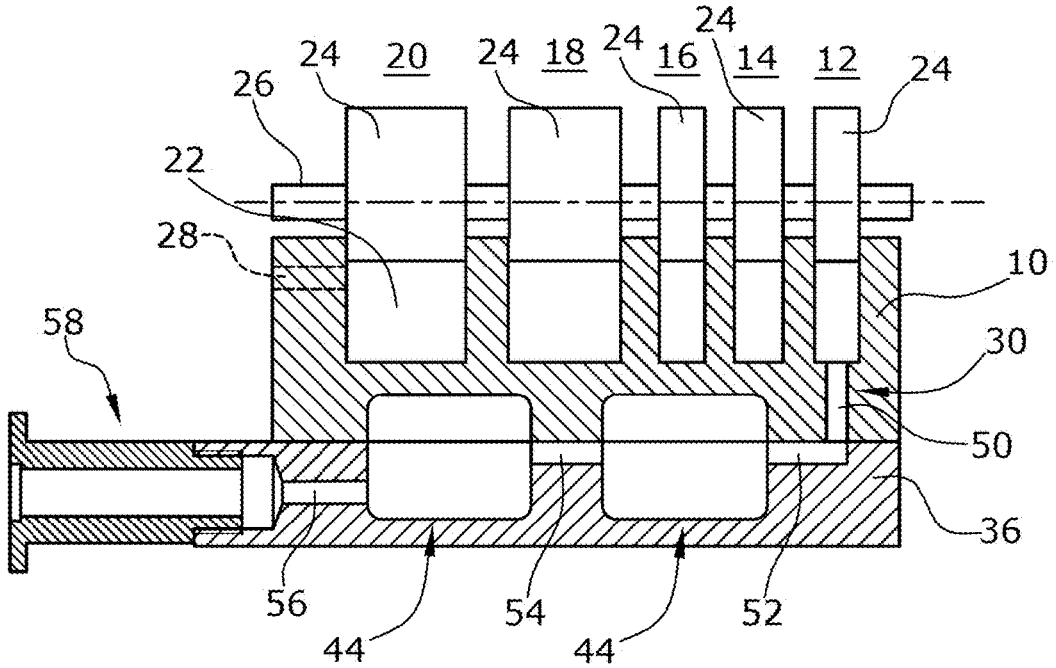
FIG. 2 shows a schematic sectional view of a vacuum pump having sound expansions spaces, which are arranged according to the disclosure, in the discharge duct.

The sectional view shown in FIG. 2 also illustrates the vacuum pump shown in FIG. 1 according to a preferred embodiment, wherein a different sectional plane is selected that, relative to the sectional plane illustrated in FIG. 1, lies in front of or behind the latter. The portion of the vacuum pump illustrated in FIG. 2 is the outlet. Here, the discharge duct 30 comprises a duct section 50 arranged as a bore in the housing 10. A groove arranged in the housing cover 36 and forming another duct section 52 adjoins the duct section 30. A sound expansion space 44 adjoins the former in the direction of flow in accordance with the configuration of the inlet duct of FIG. 1, which sound expansion space is connected to a duct section 54 configured as a groove in the cover 36. Another sound expansion space 44 adjoins said duct section, which sound expansion space is then connected to another duct section 56. The duct section 56 enters the exhaust pipe 58 or is connected therewith.

The sound expansion spaces 44 which are arranged in the discharge duct 30 and between the corresponding duct sections 52, 54, 56, respectively, are configured in accordance with the sound expansion spaces 44 of the inlet duct (FIG. 1).

Figure 3:
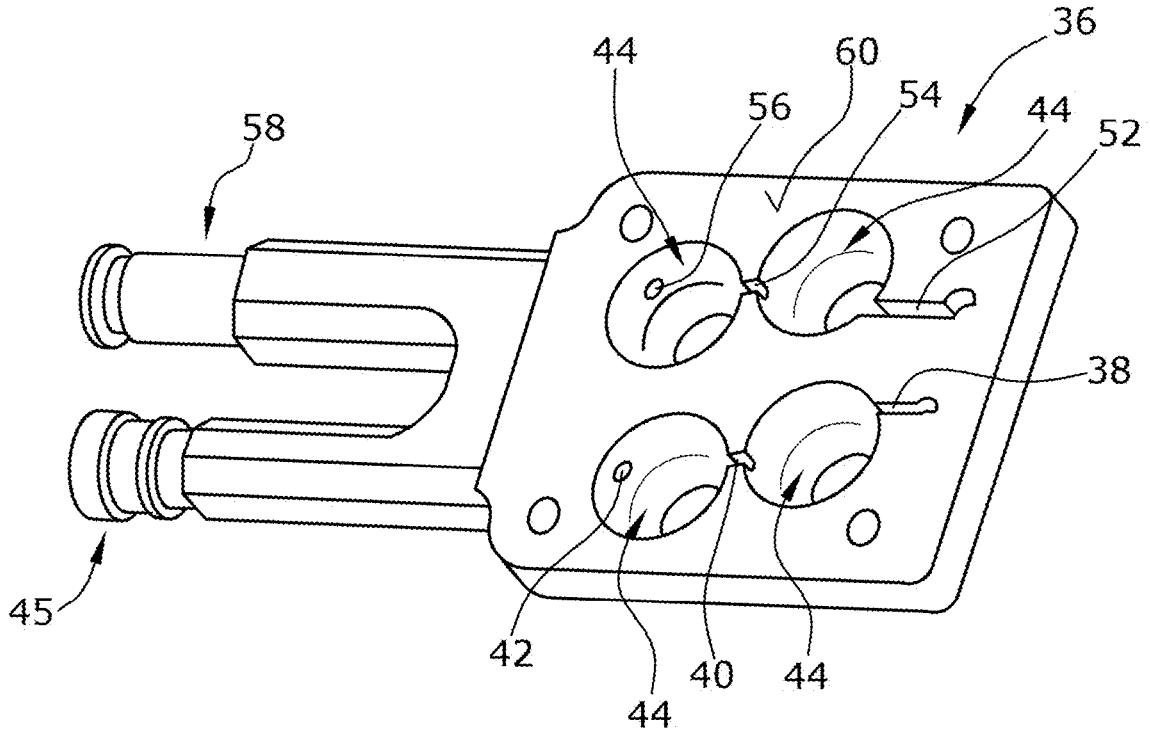
FIG. 3 shows a perspective schematic sectional view where silencers are provided both in the discharge duct and the inlet duct for gas ballast.

FIG. 3 shows a schematic perspective view of the housing cover 36, wherein an upper side 60 of the housing cover 36 abuts on a lower side 62 of the pump housing 10 in the assembled state (FIGS. 1 and 2). As can in particular be seen in FIG. 3, in the illustrated exemplary embodiment the sound expansion spaces 44 are of identical configuration. The sound expansion spaces 44 respectively comprise a circular cross-section, wherein a bottom side is rounded in the edge area. In addition, from the exemplary embodiment illustrated in FIG. 3 it can be seen that the individual duct sections 38, 40, 42 and 52, 54, 56, respectively, are arranged in a horizontally and vertically staggered manner. This staggered arrangement improves the silencing effect. The sound waves entering a sound expansion space 44 cannot directly travel into the opposite duct section due to the staggered arrangement.

Figure 4:
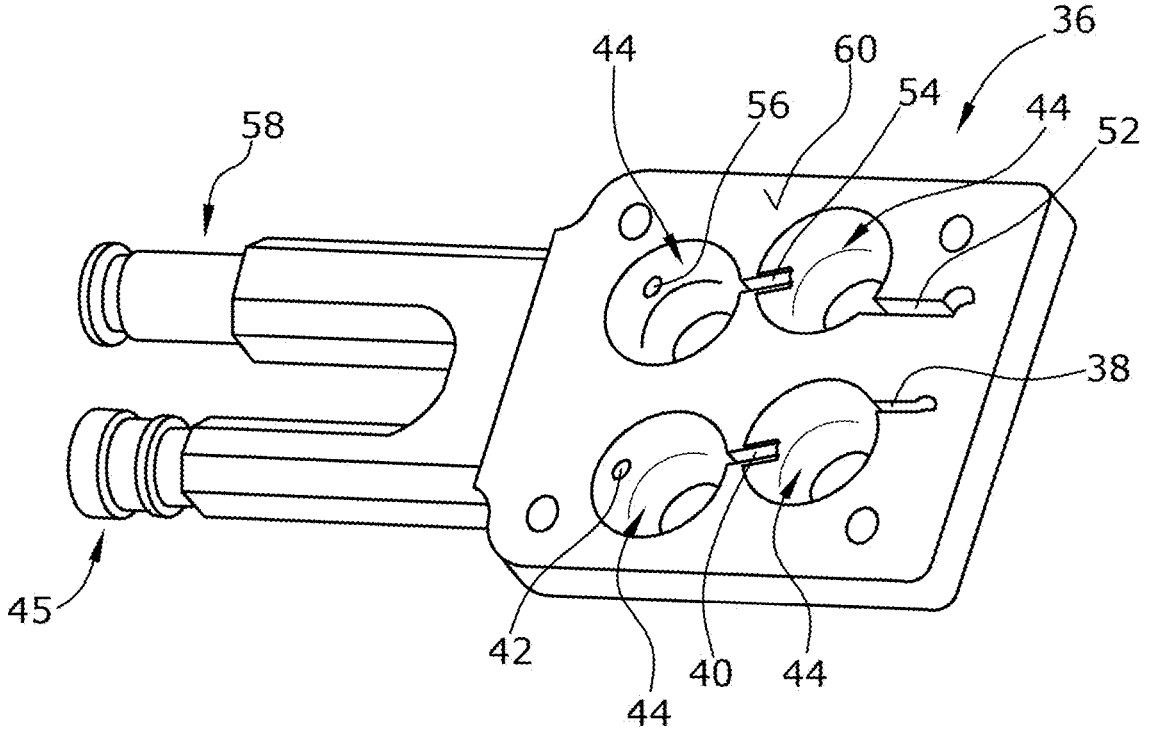
FIG. 4 shows a perspective view of an alternative embodiment essentially corresponding to FIG. 3, and FIGS. 5 to 7 show schematic diagrammatic sketches of alternative configurations of sound expansion spaces for silencing purposes.

For further improvement of the silencing effect it is possible, as illustrated in FIG. 4, to connect to the duct sections 38, 40, 42 and 52, 54, 56, respectively, pipe sections 64 which respectively project into a sound expansion space 44.

Figure 5:
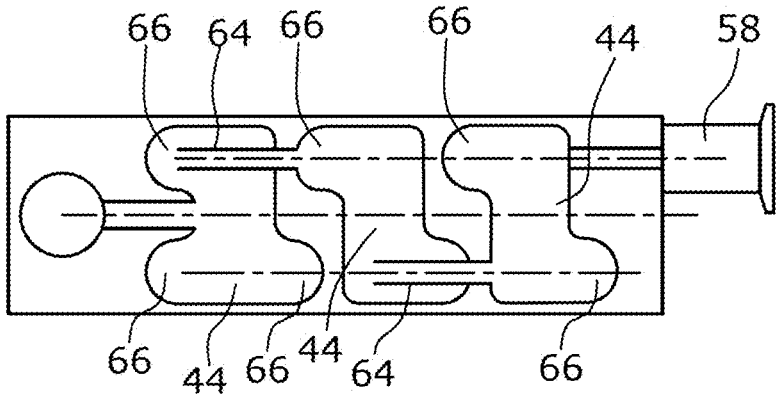
Figure 6:
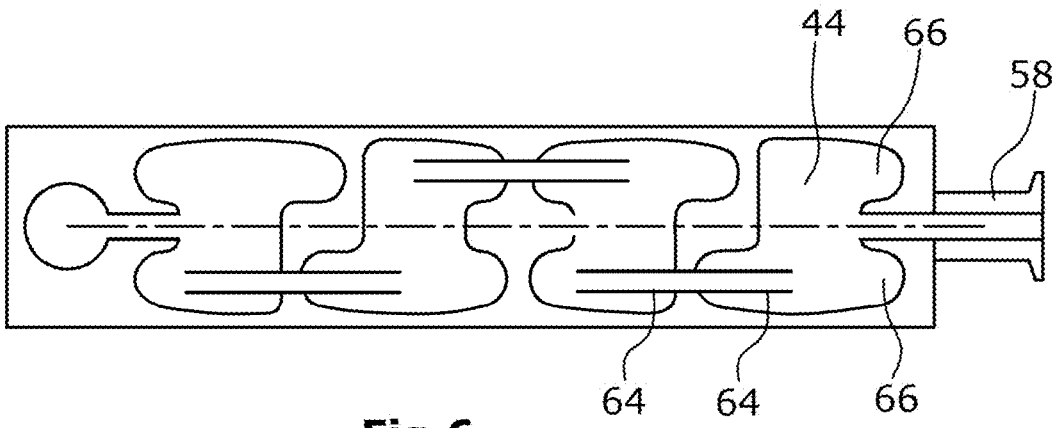
Figure 7:
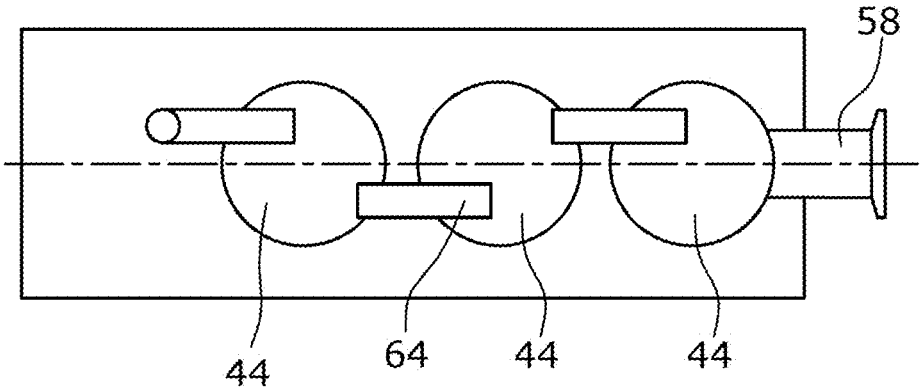

In FIGS. 5 to 7 further possible embodiments of sound expansion spaces 44 of different configurations are diagrammatically illustrated. The corresponding sound expansion spaces 44, which may be more than two series-connected sound expansion spaces 44, can be arranged for silencing purposes both for the inlet of the gas ballast and for the outlet of the gas. Here, it is particularly advantageous to provide the sound expansion spaces with additional bosses or protrusions 66, as illustrated in FIGS. 5 and 6, since thereby a further silencing effect is possible. It is also preferred that the gas flowing into and/or out of a sound expansion space 44 is guided through a pipe section 64.

The invention claimed is:

1. A two-shaft vacuum pump, comprising:

a pump housing defining a suction chamber and having a gas inlet and a gas outlet, rotor elements arranged in said suction chamber for forming a plurality of successive pump stages, an inlet duct for gas ballast connected to one of said pump stages, and at least one sound expansion space arranged between duct sections of said inlet duct and is partially integrated into said pump housing and partially integrated into a removable pump housing cover, the sound expansion space having at least one change in cross-section.

2. The vacuum pump according to claim 1, further comprising:

a discharge duct connected to the gas outlet, and the at least one sound expansion space arranged between duct sections of said discharge duct.

3. The vacuum pump according to claim 1, wherein at an inlet opening of the sound expansion space a multiple increase of the cross-section is realized.

4. The vacuum pump according to claim 1, wherein two identically configured sound expansion spaces are arranged one behind the other in the direction of flow.

5. The vacuum pump according to claim 1, wherein in the inlet duct at least two identically configured sound expansion spaces and in the outlet duct at least two identically configured sound expansion spaces are arranged.

6. The vacuum pump according to claim 1, wherein an inlet opening and an outlet opening of the at least one sound expansion space are arranged in a staggered manner relative to each other.

7. The vacuum pump according to claim 1, further comprising a gas ballast inlet which is open against the atmosphere or a rotary valve which is provided at the gas ballast inlet.

8. The vacuum pump according to claim 1, further comprising at least one duct section has connected thereto a pipe section projecting into the at least one sound expansion space.

9. A two-shaft vacuum pump, comprising:

a pump housing defining a suction chamber and having a gas inlet and a gas outlet, rotor elements arranged in said suction chamber for forming a plurality of successive pump stages, an inlet duct for gas ballast connected to one of said pump stages, at least one sound expansion space arranged between duct sections of said inlet duct and is partially integrated into said pump housing and partially integrated into a removable pump housing cover, a discharge duct connected to the gas outlet, and the at least one sound expansion space arranged between duct sections of said discharge duct.

* * * * *